US009785162B2

(12) United States Patent
Chen et al.

(10) Patent No.: US 9,785,162 B2
(45) Date of Patent: Oct. 10, 2017

(54) LDO WITH HIGH POWER CONVERSION EFFICIENCY

(71) Applicant: MStar Semiconductor, Inc., Hsinchu Hsien (TW)

(72) Inventors: Chun-Chia Chen, Zhubei (TW); Chao-An Chen, Zhubei (TW); Jian-Feng Shiu, Zhubei (TW); Kai-Fei Chang, Zhubei (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 0 days.

(21) Appl. No.: 15/078,042

(22) Filed: Mar. 23, 2016

(65) Prior Publication Data

US 2016/0282888 A1 Sep. 29, 2016

(30) Foreign Application Priority Data

Mar. 26, 2015 (TW) ..... 104109738 A

(51) Int. Cl.
*G05F 1/56* (2006.01)
*G05F 1/575* (2006.01)

(52) U.S. Cl.
CPC ..... *G05F 1/56* (2013.01); *G05F 1/575* (2013.01)

(58) Field of Classification Search
CPC ..... G05F 1/56; G05F 1/575; G05F 1/46
USPC ..... 323/273–280
See application file for complete search history.

(56) References Cited

U.S. PATENT DOCUMENTS

2007/0170901 A1* 7/2007 Eberlein ..... G05F 1/575 323/276
2008/0204958 A1* 8/2008 Shearon ..... H02H 3/18 361/93.9
2013/0021701 A1* 1/2013 Yin ..... H02H 3/20 361/79
2013/0200870 A1* 8/2013 Pradhan ..... G05F 1/10 323/283

(Continued)

FOREIGN PATENT DOCUMENTS

CN 1851602 A 10/2006
CN 203405752 U 1/2014

OTHER PUBLICATIONS

TIPO Office Action, May 10, 2016, 5 pages.

*Primary Examiner* — Adolf Berhane
*Assistant Examiner* — Bart Iliya
(74) *Attorney, Agent, or Firm* — Edell, Shapiro & Finnan, LLC

(57) ABSTRACT

An LDO with high efficiency receives an input voltage from an input power line and outputs an output voltage at an output power line. The LDO includes a first active device, a second active device, an operational amplifier and a protection circuit. The first and second active devices are connected in series between the input and output power lines via a connecting node. The operational amplifier controls the second active device according to the output voltage and a core power voltage of a core power line to cause the output voltage to stabilize at a target voltage value. The protection circuit is connected to the input and output power lines, the connecting node and a control node of the first active device, and controls a voltage of the connecting node and the control node of the first active device according to the input and output voltages.

15 Claims, 8 Drawing Sheets

(56) References Cited

U.S. PATENT DOCUMENTS

2014/0015502 A1* 1/2014 Chen ..... G05F 1/56
323/281

* cited by examiner

US11989PA

LDO WITH HIGH POWER CONVERSION EFFICIENCY

This application claims the benefit of Taiwan application Serial No. 104109738, filed Mar. 26, 2015, the subject matter of which is incorporated herein by reference.

BACKGROUND OF THE INVENTION

Field of the Invention

The invention relates in general to a low dropout regulator (LDO), and more particularly to a highly efficient LDO that uses a transistor having a low withstand voltage as a driving stage.

Description of the Related Art

Power lines having different voltages are frequently required in an integrated circuit. For example, a 3.3V power line AVDD3P3, a 1.0V core power line DVDD, a 1.5V input/output (I/O) power line AVDD1P5, and a 1.0V clock tree power line AVDDTREE may be designed in an integrated circuit. An integrated circuit may receive an external power supply from only one or two fixed voltages. For other power lines having different voltages in the integrated circuit, the power voltage of each of the power lines is stabilized through conversion performed by an internal power converter. A low dropout regulator (LDO) is a type of converter, and is extensively adopted in the field of integrated circuit design because of its simple structure. Despite having the same source voltage, instead of short circuiting each other, the core power line DVDD and the clock tree power line AVDDTREE are isolated from each other to prevent noise generated at one of the power lines from affecting operations of circuits powered by the other power line.

To operate under different source voltages, transistors having different withstand voltages may also be provided within an integrated circuit. The withstand voltage of a transistor represents a maximum value of a voltage across two ends of the transistor that the transistor can withstand. Given that the voltage across the two ends of the transistor does not exceed the withstand voltage, the transistor is entrusted with sufficient reliability. For example, an integrated circuit includes a core circuit. The core circuit is primarily used for logic operations, and includes core devices, e.g., a core NMOS transistor and a core PMOS transistor. To achieve a high operation speed and low power consumption, the core circuit is powered by the 1V core power line DVDD, and the core device has a withstand of only 1V. An integrated circuit may further include I/O devices, e.g., an I/O NMOS transistor and an I/O PMOS transistor. To have a higher capability of withstanding external high-voltage signals, an I/O device may need a withstand voltage that is as high as 1.5V, and may be powered by the 1.5V I/O power line AVDD1P5. In general, a device having a higher withstand voltage needs to achieve a certain current driving capability, and includes circuits that occupy a greater silicon area and have higher costs. In the application, the withstand voltages of the I/O device and the core device are respectively 1.5V and 1V, for example. However, given that the withstand voltage of the I/O device is greater than the withstand voltage of the core device, the prevent invention is not limited to the above exemplary values.

FIG. 1A shows a conventional LDO 10, which adopts a 3.3V I/O device NMOS transistor MN_3P3 as a driving stage. A 3.3V power line AVDD3P3 is used as the main input power line in the LDO 10 to expectantly generate a stable 1.0V voltage at an output power line LDO_OUT. The output power line LDO_OUT may serve as the clock tree power line AVDDTREE to power a clock tree required by an I/O circuit satisfying the double data rate (DDR) specifications. However, the LDO 10 suffers from a severe drawback of being extremely power consuming. In normal operations, in a stable state, because the drain-source voltage ($V_{DS}$) of the NMOS transistor MN_3P3 is as high as 2V and consumes electric power that is a product of the output current of the LDO 10 and 2V, the NMOS transistor MN_3P3 consumes a substantial amount of electric power.

FIG. 1B shows another conventional LDO 20. The main input power line of the LDO 20 is a 1.5V I/O power line AVDD1P5, and the LDO 20 uses an I/O device NMOS transistor MN_1P5 as a driving stage. The LDO 20 is more power saving than the LDO 10 since $V_{DS}$ of the NMOS transistor MN_1P5 is only 0.5V. However, to achieve a sufficient driving current with such low $V_{DS}$ and further under considerations of silicon area and power supply rejection ratio (PSRR), the realization of the NMOS transistor MN_1P5 is made enormously challenging.

SUMMARY OF THE INVENTION

According to an embodiment of the present invention, a low dropout regulator (LDO) is provided. The LDO receives an input voltage from an input power line and outputs an output voltage at an output power line. The LDO includes a first active device, a second active device, an operational amplifier and a protection circuit. The first active device and the second active device both have a withstand voltage, and are connected in series between the input power line and the output power line via a connecting node. The operational amplifier is connected to a control node of the second active device, and controls the second active device according to the output voltage and a core power voltage of a core power line to cause the output voltage to stabilize at a target voltage value. The protection circuit is connected to the input power line, the output power line, the connecting node and a control node of the first active device, and controls a voltage of the connecting node and the control node of the first active device according to the input voltage and the output voltage.

According to another embodiment of the present invention, a voltage conversion method is provided. The voltage conversion method is applied to an LDO that receives an input voltage from an input power line and outputs an output voltage at an output power line. The LDO includes a first active device, a second active device and an operational amplifier. The first active device and the second active device are connected in series between the input power line and the output power line. The first active device and the second active device both have a withstand voltage. The operational amplifier is connected to a control node of the second active device. The voltage conversion method includes: controlling the second active device according to the output voltage and a core power voltage of a core power line to cause the output voltage to stabilize at a target voltage value; and controlling a voltage of the connecting node and the control node of the first active device according to the input voltage and the output voltage.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1A:
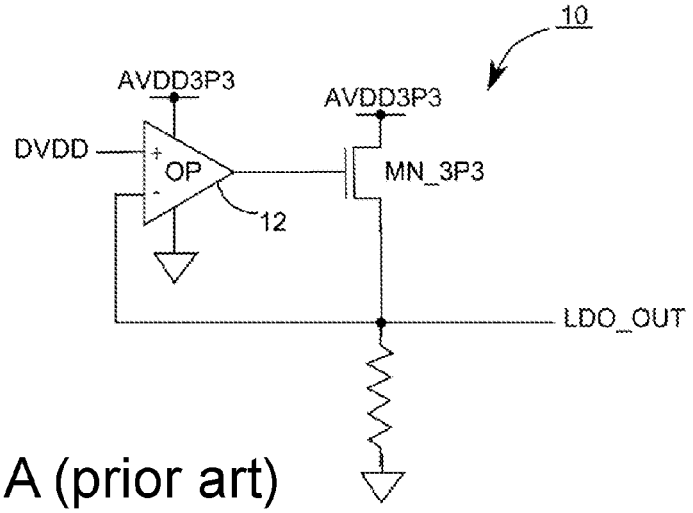
FIG. 1A (prior art)
FIG. 1A is a conventional low dropout regulator (LDO)
Figure 1B:
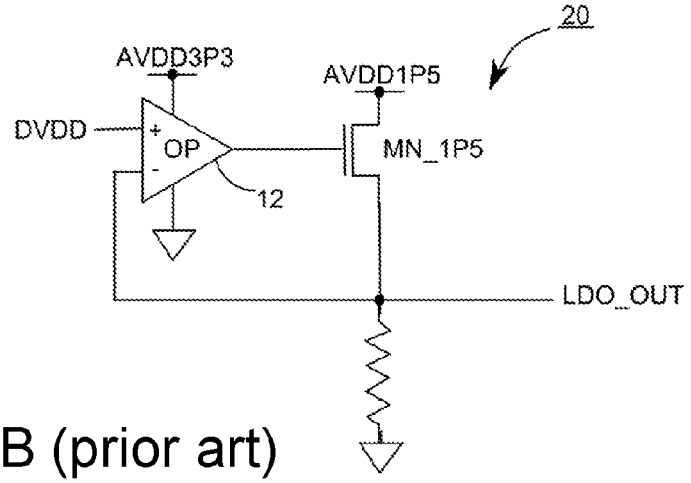
FIG. 1B (prior art)
FIG. 1B is another conventional LDO.
Figure 1C:
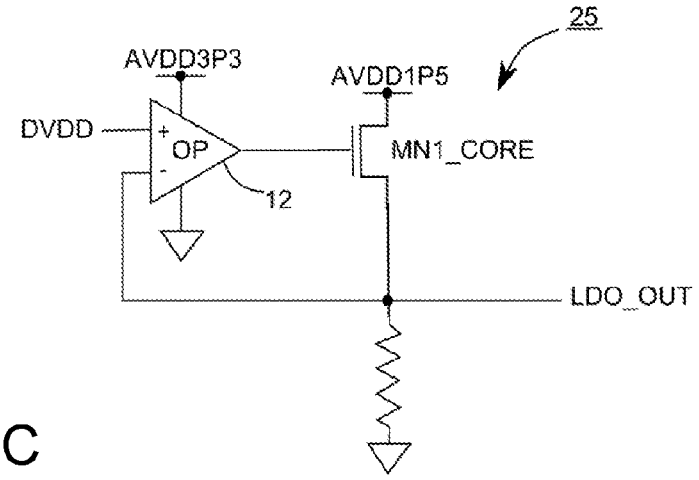
FIG. 1C is an imaginary LDO.

FIG. 1C shows an imaginary LDO 25. Compared to FIG. 1B, the driving stage in the LDO 25 is implemented by an NMOS transistor MN1_CORE which is a core device. Unfortunately, the LDO 25 suffers from reliability issues. For example, in a power sequence, the I/O power line AVDD1P5 in FIG. 1C serves as a main power line. It is possible that only after the main source voltage on the main input power line AVDD1P5 reaches 1.5V, the operational amplifier 12 then starts to pull the gate of the NMOS transistor MN1_CORE from 0V, and the output voltage on the output power line LDO_OUT slowly approaches a target voltage value (1V) from 0V. It is discovered that, the drain-gate voltage ($V_{DG}$) and the drain-source voltage ($V_{DS}$) of the NMOS transistor MN1_CORE have a maximum value of approximately 1.5V, which exceeds the withstand voltage (1V) of the NMOS transistor MN1_CORE. Thus, due to the excessively high cross voltages of the NMOS transistor MN1_CORE in the LDO 25, reliability issues are caused in actual applications.

Figure 2:
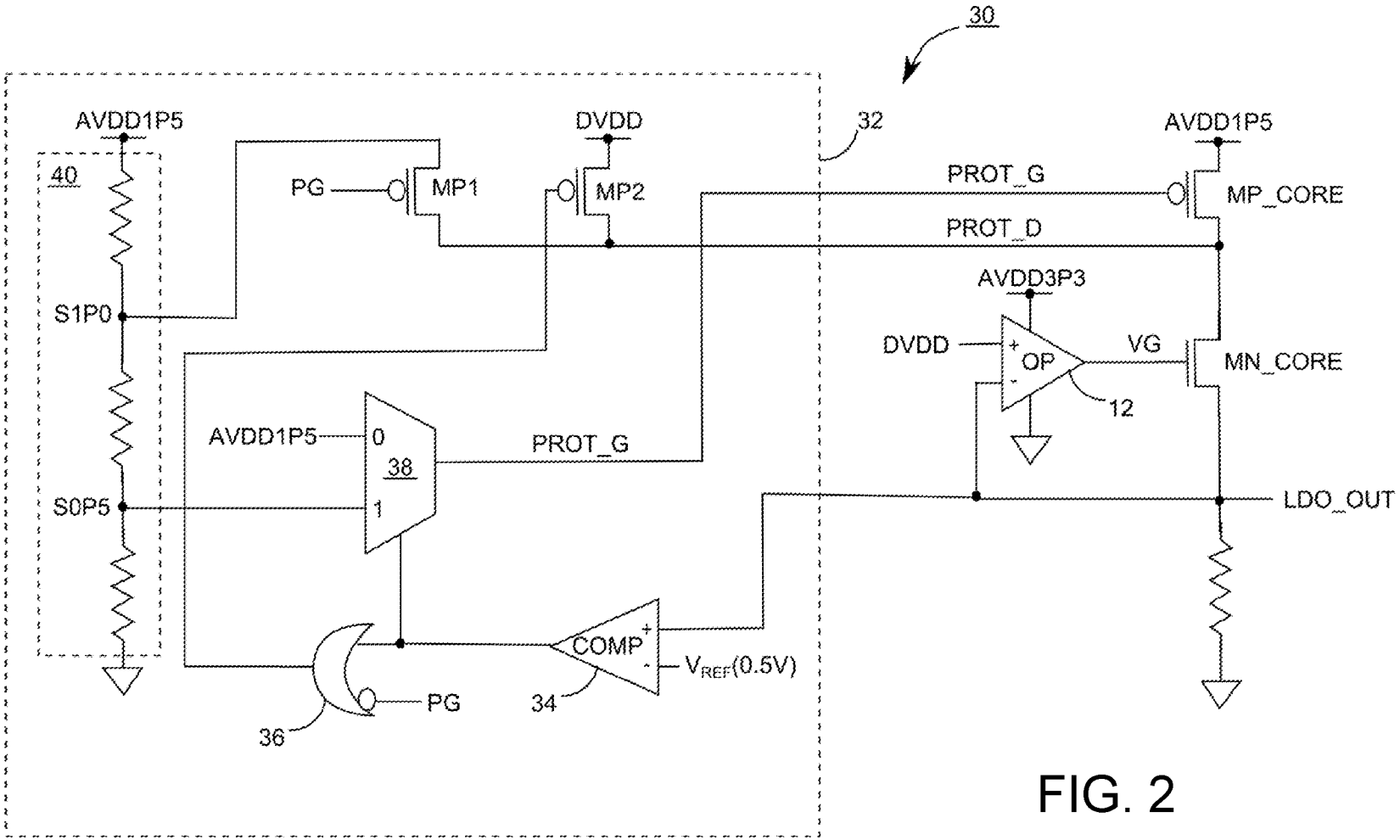
FIG. 2 is an LDO according to an embodiment of the present invention.

FIG. 2 shows an LDO 30 according to an embodiment of the present invention. A driving stage of the LDO 30 includes a PMOS transistor MP_CORE (a first active device) and an NMOS transistor MN_CORE (a second active device), both being core devices. The PMOS transistor and the NMOS transistor are examples in the embodiment of the present invention, and are not to be construed as limitations to the present invention. For example, in other embodiments, the active device may be a vacuum tube, a field-effect transistor (FET), or a bipolar junction transistor (BJT). An input/output (I/O) power line AVDD1P5 serves as a main input power line connected to the source of the PMOS transistor MP_CORE. In a stable state, the source voltage of the I/O power line AVDD1P5 is 1.5V. An output power line LDO_OUT is connected to the source of the NMOS transistor MN_CORE. The drains of the PMOS transistor MP_CORE and the NMOS transistor MN_CORE are both connected to a connecting node PROT_D. As shown in FIG. 2, the PMOS transistor MP_CORE and the NMOS transistor MN_CORE are connected in series between the I/O power line AVDD1P5 and the output power line LDO_OUT. The PMOS transistor MP_CORE has a gate PROT_G, and the NMOS transistor MN_CORE has a gate VG.

An operational amplifier 12 is powered by a 3.3V power line AVDD3P3, and has two input ends respectively connected to a core power line DVDD and the output power line LDO_OUT. The output of the operational amplifier 12 is connected to the gate VG. In a stable state, the source voltage on the core power line DVDD is 1.0V, and so the output voltage on the output power line LDO_OUT is also 1.0V (the target voltage value) in a stable state.

The LDO 30 further includes a protection circuit 32, which is coupled to the output power line LDO_OUT, the core power line DVDD and the I/O power line AVDD1P5. The protection circuit 32 controls the gate PROT_G and the connecting node PROT_D. In a power sequence, the protection circuit 32 ensures that a voltage between any two ends, e.g., $V_{DS}$, $V_{GD}$ or $V_{GS}$, of the PMOS transistor MP_CORE and the NMOS transistor MN_CORE, does not exceed the withstand voltage (1V) of the core device. Therefore, the protection circuit 32 ensures that the PMOS transistor MP_CORE and the NMOS transistor MN_CORE are free from reliability issues.

The protection circuit 32 includes a voltage dividing circuit 40 connected between the I/O power line AVDD1P5 and a ground line. The voltage dividing circuit 40 includes three resistors, and is connected to voltage dividing nodes S1P0 and S0P5. In one embodiment, the three resistors have about the same resistance value. In a stable state, the main source voltage of the I/O power line AVDD1P5 is approximately 1.5V, and the voltages of the voltage dividing nodes S1P0 and S0P5 are respectively approximately 1V and 0.5V.

A PMOS transistor MP1 (a third active device) is connected between the voltage dividing node S1P0 and the connecting node PROT_D, and a PMOS transistor MP2 (a fourth active device) is connected between the core power line DVDD and the connecting node PROT_D. In one embodiment, the PMOS transistors MP1 and MP2 are both core devices. In another embodiment, the PMOS transistors MP1 and MP2 are both I/O devices.

A comparator 34 compares a predetermined safety value $V_{REF}$ with the output voltage of the output power line LDO_OUT. In the embodiment, the predetermined safety value $V_{REF}$ is 0.5V, and is lower than the target voltage value (1.0V) of the output power line LDO_OUT in a stable state.

A multiplexer 38 includes two input ends respectively connected to the voltage dividing node S0P5 and the I/O power line AVDD1P5, and an output end connected to the gate PROT_G of the PMOS transistor MP_CORE. It is known from FIG. 2 that, when the output voltage of the output power line LDO_OUT is lower than 0.5V, the multiplexer 38 connects the I/O power line AVDD1P5 to the gate PROT_G. Conversely, when the output voltage of the output power line LDO_OUT exceeds 0.5V, the multiplexer 38 connects the voltage dividing node S0P5 to the gate PROT_G.

The PMOS transistor MP1 and an OR gate 36 receive an inverted signal of a power-normal signal PG, whose logic value is determined according to the core source voltage of the core power line DVDD. For example, when the core source voltage is greater than 0.9V (a core normal value), the core source voltage is regarded as having reached 1V of a stable state, and so the power-normal signal PG becomes logic "1" and the voltage level is a high voltage value. Conversely, when the core source voltage is smaller than 0.9V, the power-normal signal PG is logic "0", and the voltage level is a low voltage value. For a core device, the high voltage value is 1V, and for an I/O device, the high voltage value is 1.5V.

Figure 3:
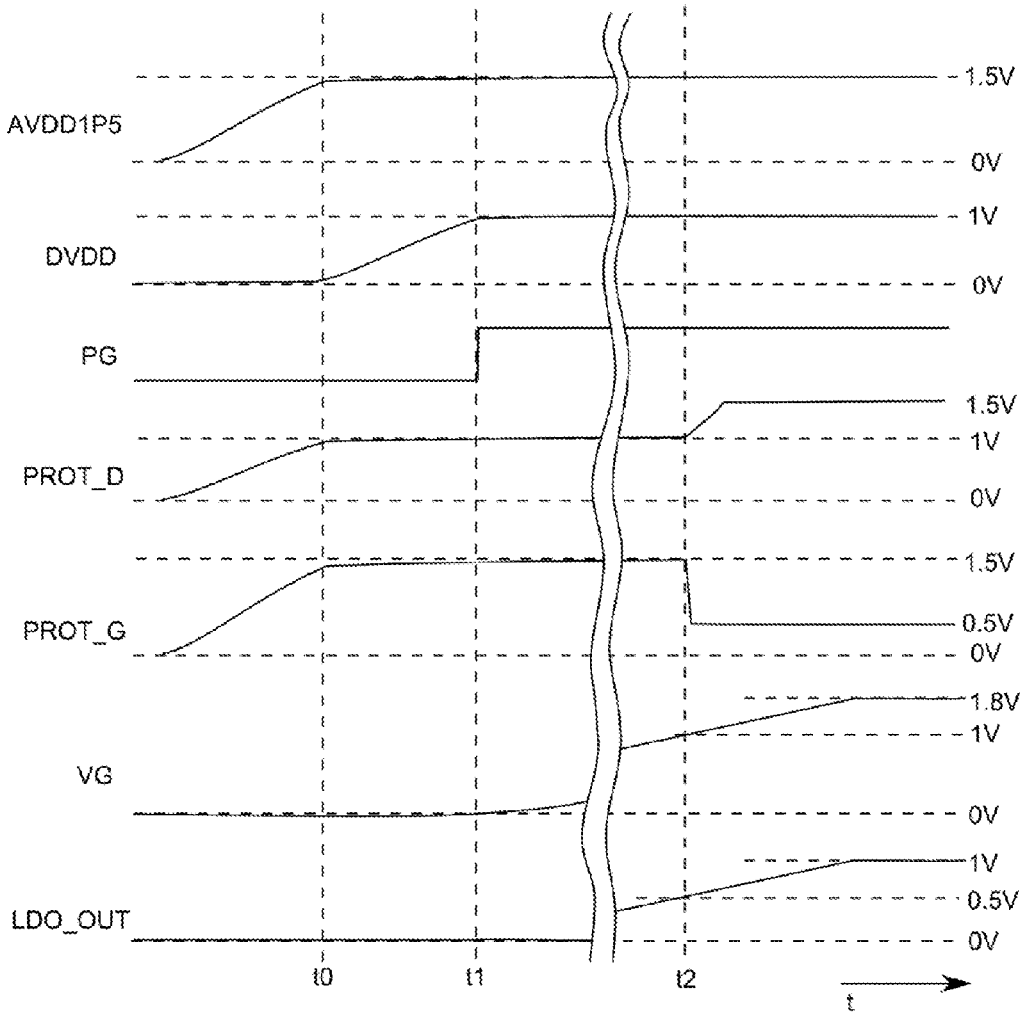
FIG. 3 shows waveforms of signals in FIG. 2.

FIG. 3 shows waveforms of some signals in FIG. 2. From top to bottom, these waveforms represent the main source voltage of the I/O power line AVDD1P5, the core source voltage of the core power line DVDD, the logic value of the power-normal signal PG, the voltage of the connecting node PROT_D, the voltage of the connecting node PROT_G, the voltage of the gate VG, and the output voltage of the output power line LDO_OUT. In FIG. 3, assuming that the power sequence is sequentially powering the I/O power line AVDD1P5, the core power line DVDD and then the output power line LDO_OUT.

Figure 4:
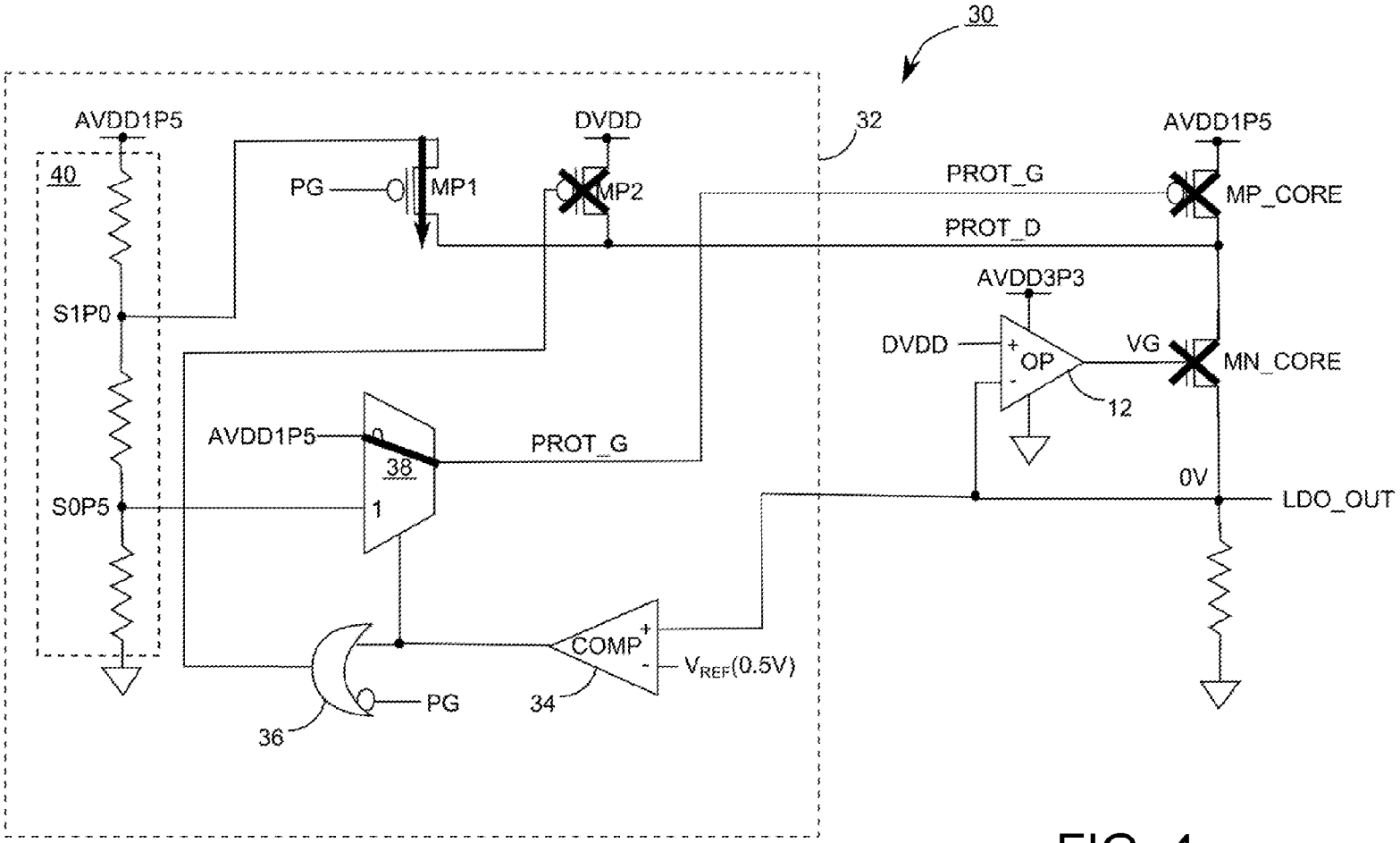
FIG. 4 depicts device states of devices in FIG. 2 before a time point t1.

Referring to FIG. 3 and FIG. 4, FIG. 4 depicts device states of some devices in FIG. 2 before a time point t1. In FIG. 4, it is shown that, before the time point t1, the PMOS transistor MP1 is turned on, the PMOS transistor MP2 is turned off, the PMOS transistor MP_CORE is turned off, the NMOS transistor MN_CORE is turned off, and the multiplexer 38 connects the I/O power line AVDD1P5 to the gate PROT_G.

When the LDO 30 is first powered on, the main source voltage of the I/O power line AVDD1P5 starts rising from 0V, and reaches 1.5V of a stable state at a time point t1. The voltages of the voltage dividing nodes S1P0 and S0P5 are respectively ⅔ and ⅓ of the main source voltage, and so also rise along with the main source voltage to respectively reach 1V and 0.5V of a stable state at the time point t0. Before the time point t1, the output voltage of the output power line LDO_OUT is approximately 0V, the comparator 34 outputs a logic value "0" to control the multiplexer 38, which accordingly connects the I/O power line AVDD1P5 to the gate PROT_G, such that the PMOS transistor MP_CORE is turned off. Before the time point t1, as the core source voltage of the core power line DVDD is still too low, the power-normal signal PG is logic "0", the PMOS transistor MP1 is turned on, and the voltage dividing node S1P0 is short circuited with the connecting node PROT_D. Thus, before the time point t1, the connecting voltage of the connecting node PROT_D rises along with the voltage of the voltage dividing node S1P0 and stays at 1V, as shown in FIG. 3. Further, the power-normal signal PG having a logic value "0" and the logic value "0" outputted by the comparator 34 simultaneously cause the OR gate 36 to output a logic value "1", and so the PMOS transistor MP2 is turned off. As shown in FIG. 3, before the time point t1, the voltage value of the gate VG is approximately 0V, and so the NMOS transistor MN_CORE is turned off.

Figure 5:
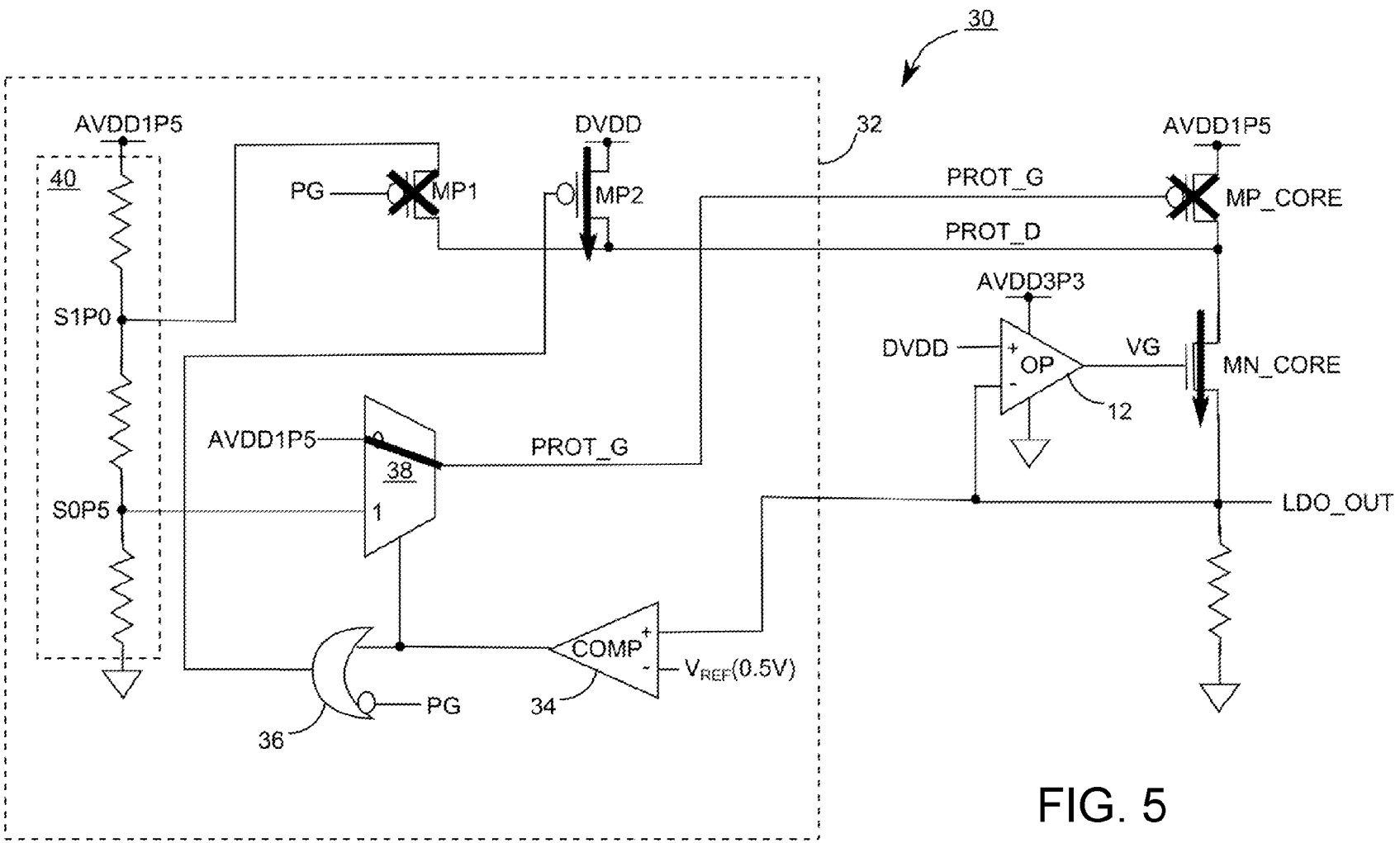
FIG. 5 depicts device states of devices in FIG. 2 between time points t1 and t2.

Referring to FIG. 3 and FIG. 5, FIG. 5 depicts device states of some devices in FIG. 2 between time points t1 and t2. In FIG. 5, it is shown that, between the time points t1 and t2, the PMOS transistor MP1 is turned off, the PMOS transistor MP2 is turned on, the PMOS transistor MP_CORE is turned off, the NMOS transistor MN_CORE is turned on, and the multiplexer 38 connects the I/O power line AVDD1P5 to the gate PROT_G.

At the time point t1, the core source voltage of the core power line DVDD is substantially stable, and the power-normal signal PG transits to logic "1". Thus, the PMOS transistor MP1 is turned off, the PMOS transistor MP2 is turned on, and the connecting voltage of the connecting node PROT_D is kept at 1V of the core power line DVDD. After the time point t1, the operational amplifier 12 slowly pulls up the voltage of the gate VG, and the NMOS transistor MN_CORE is caused to be turned on and the output voltage of the output power line LDO_OUT is also pulled up, as shown in FIG. 3. The output voltage of the output power line LDO_OUT reaches 0.5V (the predetermined safety value $V_{REF}$) at the time point t2.

Figure 6:
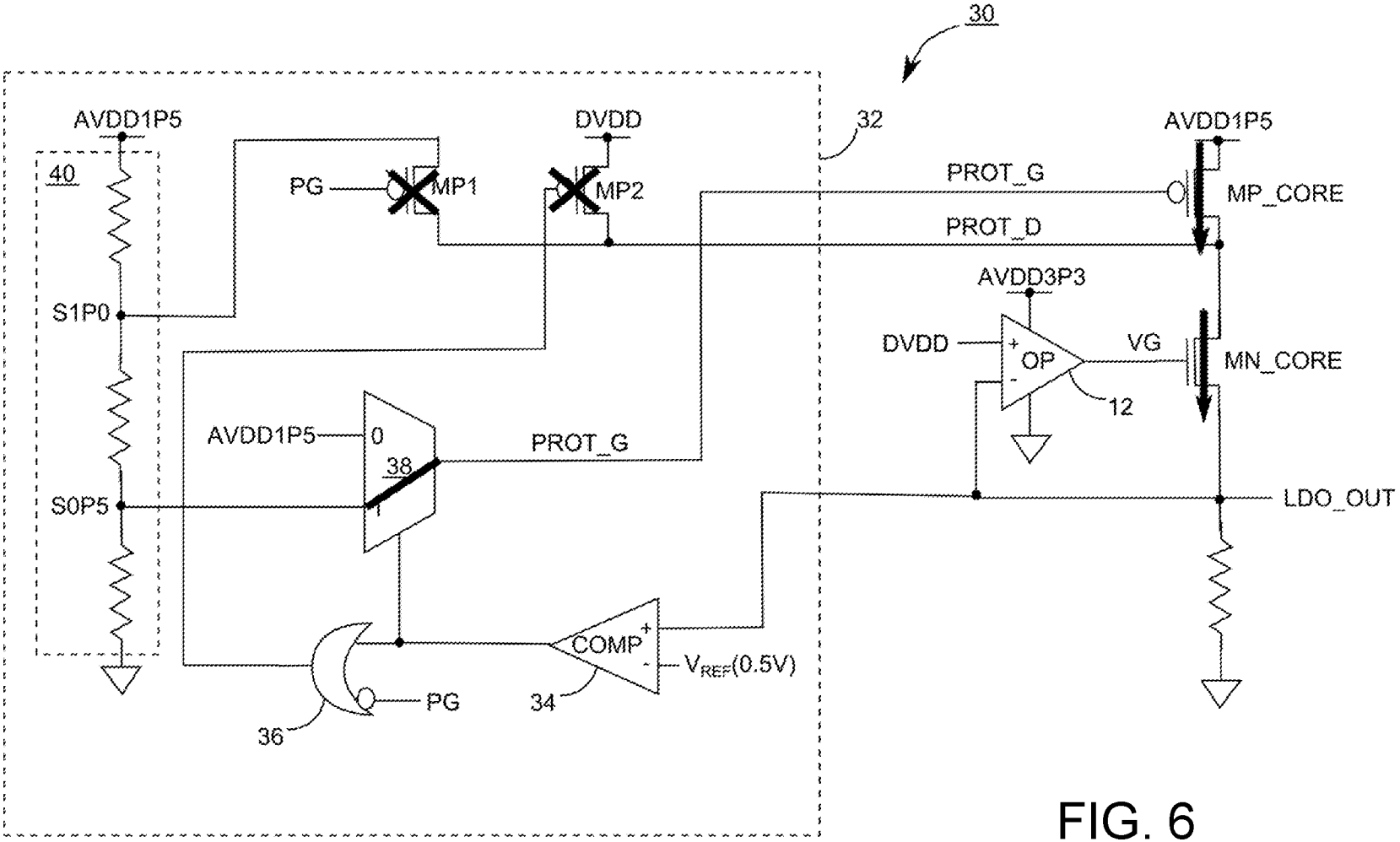
FIG. 6 depicts device states of devices in FIG. 2 after a time point t2.

Referring to FIG. 3 and FIG. 6, FIG. 6 depicts device states of some devices in FIG. 2 after the time point t2. In FIG. 6, it is shown that, the PMOS transistor MP1 is turned off, the PMOS transistor MP2 is turned off, the PMOS transistor MP_CORE is turned on, the NMOS transistor MN_CORE is turned on, and the multiplexer 38 connects the voltage dividing node S0P5 to the gate PROT_G.

After the time point t2, the output voltage of the output power line LDO_OUT exceeds 0.5V, and so the OR gate 36 turns off the PMOS transistor MP2, and the multiplexer 38 connects the voltage dividing node S0P5 to the gate PROT_G. The voltage of the gate PROT_G and the voltage of the voltage dividing node S0P5 are the same and are both 0.5V, such that the PMOS transistor MP_CORE is turned on to pull up the connecting voltage of the connecting node PROT_D to 1.5V. After the time point t2, the operational amplifier 12 continues pulling up the voltage of the gate VG, such that the NMOS transistor MN_CORE pulls up the output voltage of the output power line LDO_OUT until the output voltage of the output power line LDO_OUT stabilizes at the target voltage value (1.0V), as shown in FIG. 3. As seen from FIG. 3, at any time point, a voltage across any two ends of each device of the PMOS transistor MP_CORE and the NMOS transistor MN_CORE is smaller than or equal to 1V, hence eliminating the reliability issue.

In a stable state, a current is supplied to the driving stage of the LDO 30 by core devices (one PMOS transistor MP_CORE and one NMOS transistor MN_CORE). It is known from design and simulation results that, from aspects of both silicon area and power supply rejection ratio (PSRR) considerations, the performance of the LDO 30 is superior to the performance of the conventional LDOs 10 and 20 that supply a current through I/O devices.

Figure 7:
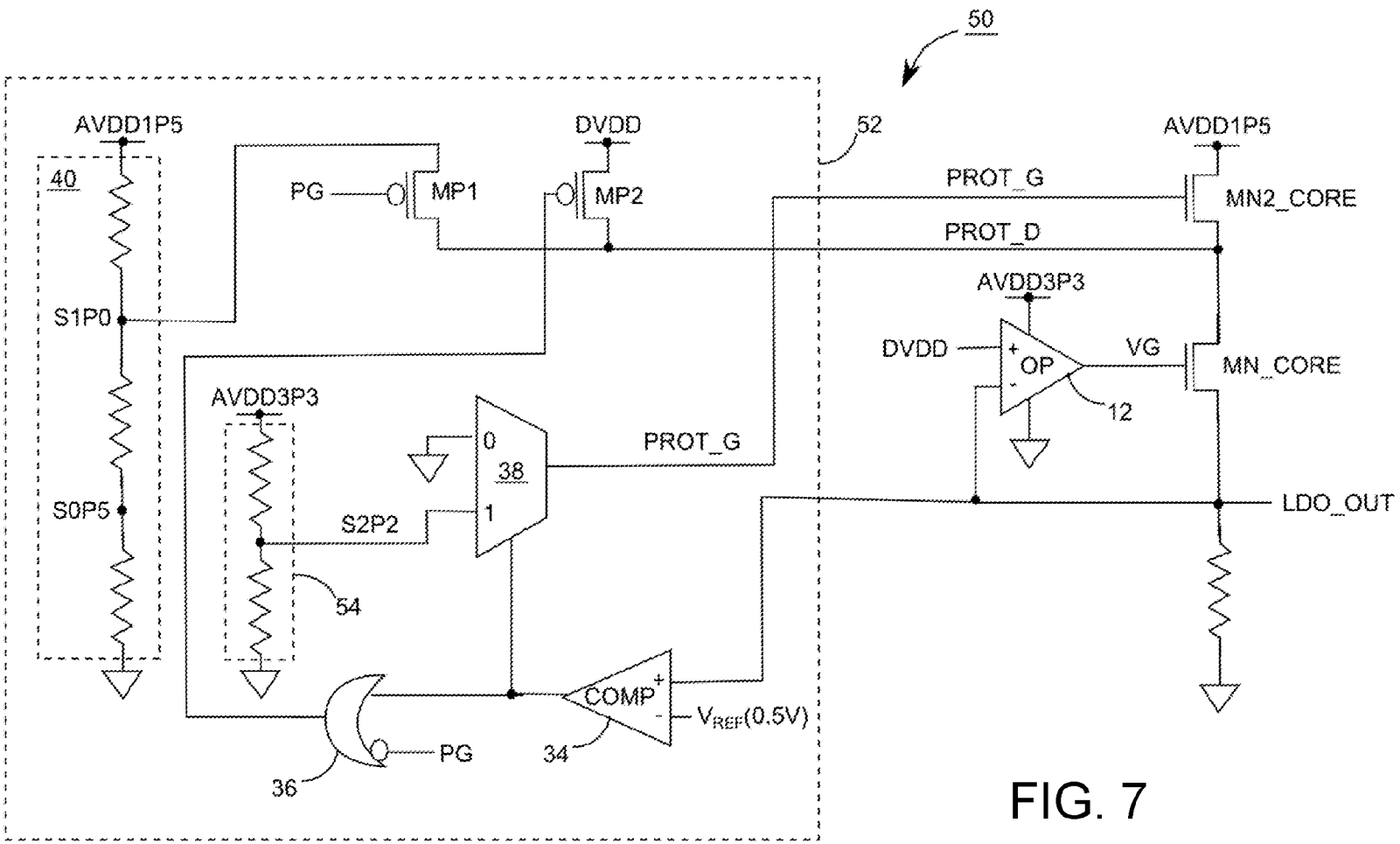
FIG. 7 and FIG. 8 are LDOs according to another two embodiments of the present invention.

FIG. 7 shows another embodiment of the present invention. In an LDO 50, the PMOS transistor MP_CORE in the embodiment in FIG. 2 is replaced by an NMOS transistor MN2_CORE. As the NMOS transistor MN2_CORE requires a higher gate voltage to be turned on, the LDO 50 further includes another voltage dividing circuit 54, which is coupled between a 3.3V power line AVDD3P3 and a ground line and provides a 2.2V voltage through a voltage dividing node S2P2. When the comparator 34 outputs a logic value "0", the multiplexer 38 grounds the connecting node PROT_G to ensure that the NMOS transistor MN2_CORE is turned off. When the comparator 34 outputs a logic value "1", the multiplexer 38 connects the connecting node PROT_G to the 2.2V voltage to turn on the NMOS transistor MN2_CORE.

Figure 8:
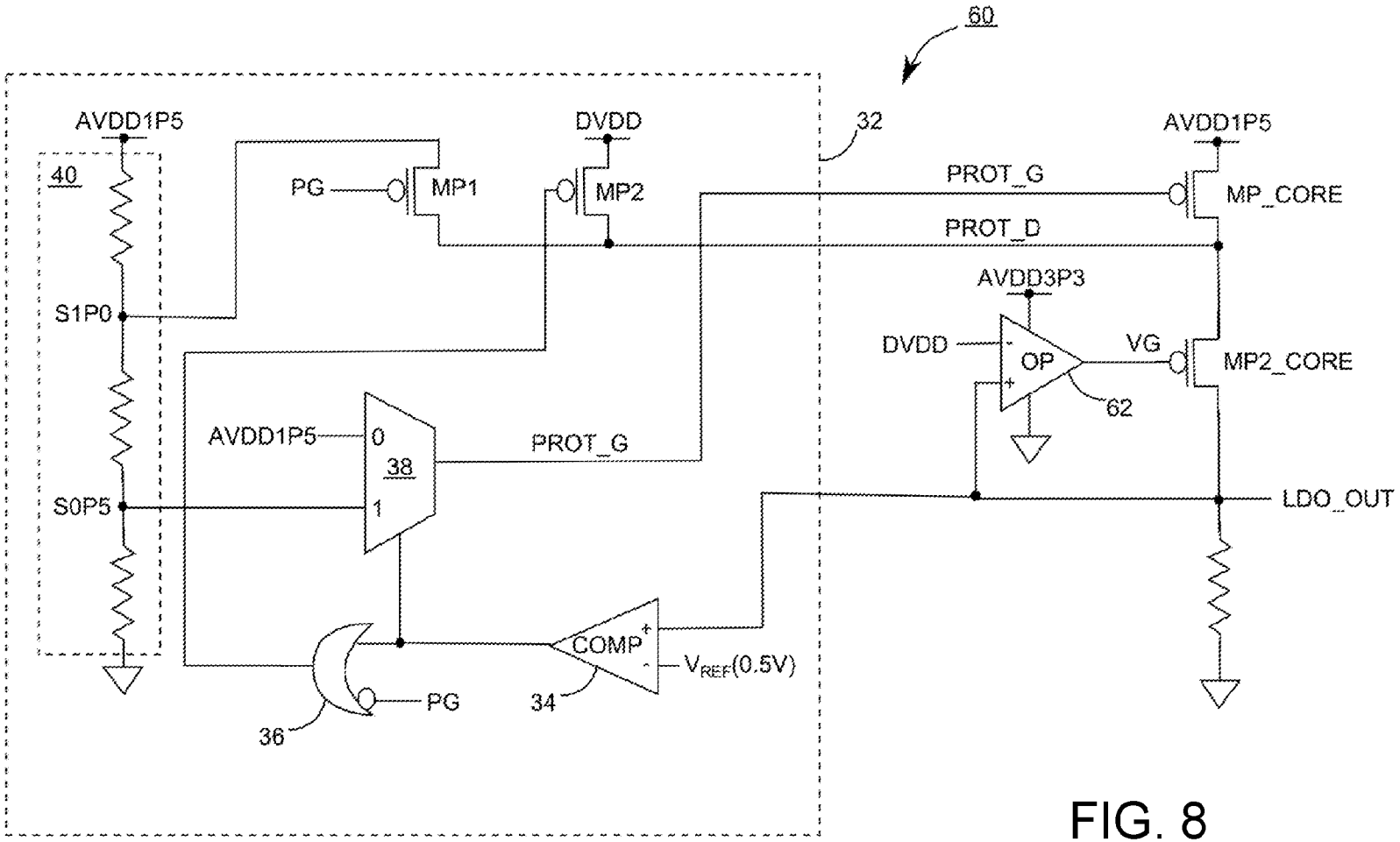

FIG. 8 shows another embodiment of the present invention. In an LDO 60, the NMOS transistor MN_CORE in FIG. 2 is replaced by a PMOS transistor MP2_CORE. Further, the two input ends of the operational amplifier 12 in FIG. 2 are swapped to become an operational amplifier 62 in FIG. 8. However, replacing the NMOS transistor MN_CORE by the PMOS transistor MP2_CORE may cause a less satisfactory PRSS.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A low dropout regulator (LDO), receiving an input voltage from an input power line and outputting an output voltage at an output power line, the LDO comprising:

a first active device and a second active device, both having a withstand voltage, connected in series between the input power line and the output power line via a connecting node;

an operational amplifier, connected to a control node of the second active device, controlling the second active device according to the output voltage and a core source voltage of a core power line to cause the output voltage to stabilize at a target voltage value; and a protection circuit, connected to the input power line, the output power line, the connecting node and a control node of the first active device, controlling a voltage of the connecting node and the control node of the first active device according to the input voltage and the output voltage, wherein the protection circuit comprises a voltage dividing circuit connected between the input power line and a ground line and having a voltage dividing node, and the protection circuit controls the voltage dividing node to be electrically connected to the connecting node when the core source voltage is lower than a predetermined value.

2. The LDO according to claim 1 wherein the protection circuit further comprises a third active device connected between the first voltage dividing node and the connecting node.

3. The LDO according to claim 2, wherein the withstand voltage is a first withstand voltage, and the third active device has a second withstand voltage equal to the input voltage.

4. The LDO according to claim 2, wherein the withstand voltage is a first withstand voltage, and the third active device has a second withstand voltage equal to the predetermined value.

5. The LDO according to claim 1, wherein when the core source voltage is a predetermined value and the output voltage is lower than a predetermined safety value, the protection circuit controls the core power line to be electrically connected to the connecting node, and the predetermined safety value is lower than the target voltage value.

6. The LDO according to claim 5, wherein the protection circuit further comprises a fourth active device connected between the core power line and the connecting node.

7. The LDO according to claim 6, wherein the withstand voltage is a first withstand voltage, and the fourth active device is manufactured to withstand a second withstand voltage equal to the input voltage.

8. The LDO according to claim 6, wherein the withstand voltage is a first withstand voltage, and the fourth active device has a second withstand voltage equal to the predetermined value.

9. The LDO according to claim 1, wherein the protection circuit comprises a comparator that compares the output voltage with a predetermined safety value smaller than the target voltage value, and the protection circuit turns off the first active device when the output voltage is lower than the predetermined safety value, and turns on the first active device when the output voltage is higher than the predetermined safety value.

10. The LDO according to claim 9, wherein the protection circuit further comprises:

a first voltage dividing circuit, connected between the input power line and a ground line, having a second voltage dividing node; and a multiplexer, having two input ends respectively connected to the second voltage dividing node and the input power line, and an output end connected to the control node of the first active device;

wherein, when the output voltage is lower than the predetermined safety value, the multiplexer connects the input power line to the control node of the first active device to keep the first active device turned off; when the output voltage is higher than the predetermined safety value, the multiplexer connects the second voltage dividing node to the control node of the first active device to keep the first active device turned on.

11. The LDO according to claim 9, wherein the protection circuit further comprises:

a second voltage dividing circuit, connected between a power supply line and a ground line, having a third voltage dividing node; and a multiplexer, having two input ends respectively connected to the third voltage dividing node and grounded, and an output end connected to the control node of the first active device;

wherein, when the output voltage is lower than the predetermined safety value, the multiplexer grounds the control node of the first active device to keep the first active device turned off; when the output voltage is higher than the predetermined safety voltage, the multiplexer connects the third voltage dividing node to the control node of the first active device to keep the first active device turned on.

12. A voltage conversion method, applied to a low dropout regulator (LDO) that receives an input voltage from an input power line and outputs an output voltage at an output power line, the LDO comprising a first active device, a second active device and an operational amplifier, the first active device and the second active device connected in series between the input power line and the output power line via a connecting node, the first active device and the second active device both having a withstand voltage, the operational amplifier connected to a control node of the second active device, the voltage conversion method comprising:

controlling the second active device according the output voltage and a core source voltage of a core power line to cause the output voltage to stabilize at a target voltage value; and controlling a voltage of the connecting node and the control node of the first active device according to the input voltage and the output voltage, wherein the LDO further comprises a protection circuit, the protection circuit is connected to the input power line, the output power line, the connecting node, a control node of the first active device and the core power line, the protection circuit comprises a first voltage dividing circuit connected between the input power line and a ground line, and having a first voltage dividing node and a second voltage dividing node, the voltage conversion method further comprising:

when the core source voltage is lower than a predetermined value, the protection circuit controlling the first voltage dividing node to be electrically connected to the connecting node;

when the core source voltage is the predetermined value and the output voltage is lower than a predetermined safety value, the protection circuit controlling the core power line to be electrically connected to the connecting node, the predetermined safety value being lower than the target voltage value; and when the output voltage is higher than the predetermined safety value, the protection circuit controlling the second voltage dividing node to be electrically connected to the control node of the first active device to turn on the first active device and to cause the input power line to be electrically connected to the connecting node.

13. The voltage conversion method according to claim 12, wherein the LDO further comprises a protection circuit, the protection circuit is connected to the input power line, the output power line, the connecting node, a control node of the first active device and the core power line, the protection circuit comprises a first voltage dividing circuit and a second voltage dividing circuit, the first voltage dividing circuit is connected between the input power line and a ground line and has a first voltage dividing node, the second voltage dividing circuit is connected between a power supply line and a ground line and has a third voltage dividing node, and a voltage of the third voltage dividing node is higher than the input voltage, the voltage conversion method further comprising:

when the core source voltage is lower than a predetermined value, the protection circuit controlling the first voltage dividing node to be electrically connected to the connecting node;

when the core source voltage is the predetermined value and the output voltage is lower than a predetermined safety value, the protection circuit controlling the core power line to be electrically connected to the connecting node, the predetermined safety value being lower than the target voltage value; and when the output voltage is higher than the predetermined safety value, the protection circuit controlling the third voltage dividing node to be electrically connected to the control node of the first active device to turn on the first active device and to cause the input power line to be electrically connected to the connecting node.

14. A low dropout regulator (LDO), receiving an input voltage from an input power line and outputting an output voltage at an output power line, the LDO comprising:

a first active device and a second active device, both having a withstand voltage, connected in series between the input power line and the output power line via a connecting node;

an operational amplifier, connected to a control node of the second active device, controlling the second active device according to the output voltage and a core source voltage of a core power line to cause the output voltage to stabilize at a target voltage value; and a protection circuit, connected to the input power line, the output power line, the connecting node and a control node of the first active device, controlling a voltage of the connecting node and the control node of the first active device according to the input voltage and the output voltage, wherein when the core source voltage is a predetermined value and the output voltage is lower than a predetermined safety value, the protection circuit controls the core power line to be electrically connected to the connecting node, and the predetermined safety value is lower than the target voltage value.

15. A voltage conversion method, applied to a low dropout regulator (LDO) that receives an input voltage from an input power line and outputs an output voltage at an output power line, the LDO comprising a first active device, a second active device and an operational amplifier, the first active device and the second active device connected in series between the input power line and the output power line via a connecting node, the first active device and the second active device both having a withstand voltage, the operational amplifier connected to a control node of the second active device, the voltage conversion method comprising:

controlling the second active device according the output voltage and a core source voltage of a core power line to cause the output voltage to stabilize at a target voltage value; and controlling a voltage of the connecting node and the control node of the first active device according to the input voltage and the output voltage, wherein the LDO further comprises a protection circuit, the protection circuit is connected to the input power line, the output power line, the connecting node, a control node of the first active device and the core power line, the protection circuit comprises a first voltage dividing circuit and a second voltage dividing circuit, the first voltage dividing circuit is connected between the input power line and a ground line and has a first voltage dividing node, the second voltage dividing circuit is connected between a power supply line and a ground line and has a third voltage dividing node, and a voltage of the third voltage dividing node is higher than the input voltage, the voltage conversion method further comprising:

when the core source voltage is lower than a predetermined value, the protection circuit controlling the first voltage dividing node to be electrically connected to the connecting node;

when the core source voltage is the predetermined value and the output voltage is lower than a predetermined safety value, the protection circuit controlling the core power line to be electrically connected to the connecting node, the predetermined safety value being lower than the target voltage value; and when the output voltage is higher than the predetermined safety value, the protection circuit controlling the third voltage dividing node to be electrically connected to the control node of the first active device to turn on the first active device and to cause the input power line to be electrically connected to the connecting node.

* * * * *